United States Patent [19]

Long

[11] Patent Number: 4,685,223

[45] Date of Patent: Aug. 11, 1987

[54] CALIFORNIA-TYPE SHOE

[76] Inventor: Gordon K. Long, 25 Shady La., Merrimack, N.H. 03054

[21] Appl. No.: 787,786

[22] Filed: Oct. 15, 1985

[51] Int. Cl.[4] ..... A43B 9/10; A43B 9/02; A43B 3/14

[52] U.S. Cl. ..... 36/16; 36/11; 36/12; 36/19 R; 12/142 MC; 12/142 C; 12/142 T

[58] Field of Search ..... 36/16, 19 R, 19 A, 12, 36/11, 83, 43, 44; 12/142 MC, 142 T, 142 C

[56] References Cited

U.S. PATENT DOCUMENTS

| | | | |
|---|---|---|---|
| 1,201,879 | 10/1916 | Schwander | 36/16 |
| 3,629,961 | 12/1971 | Self | 36/44 X |
| 4,308,671 | 1/1982 | Bretschneider | 36/16 X |
| 4,367,599 | 1/1983 | Diamant | 36/44 |
| 4,501,076 | 2/1985 | Dodds | 36/11 |
| 4,551,929 | 11/1985 | Paris | 36/11 |

FOREIGN PATENT DOCUMENTS

| | | | |
|---|---|---|---|
| 93164 | 6/1923 | Austria | 36/12 |
| 525992 | 6/1921 | France | 36/16 |
| 804778 | 8/1936 | France | 36/12 |
| 1028247 | 2/1953 | France | 36/16 |
| 426887 | 11/1947 | Italy | 36/16 |
| 2068211 | 8/1981 | United Kingdom | 36/11 |

*Primary Examiner*—James Kee Chi

*Attorney, Agent, or Firm*—Wolf, Greenfield & Sacks

[57] ABSTRACT

A California-type shoe having an upper with a folded-over edge, a sock-lining and a sole having a stitching edge. The folded-over edge captures the sock-lining to form a three-layer seam, which seam is sewn directly to the stitching edge of the sole.

16 Claims, 17 Drawing Figures

FIG. 3A
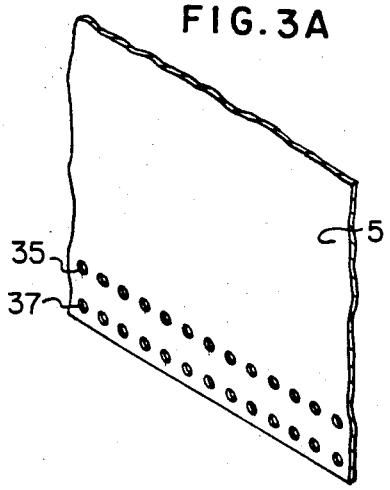
FIG. 3B
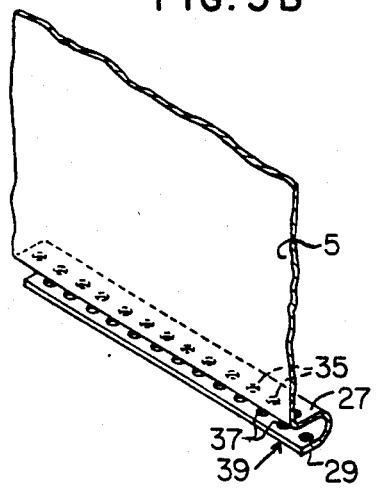
FIG. 3C
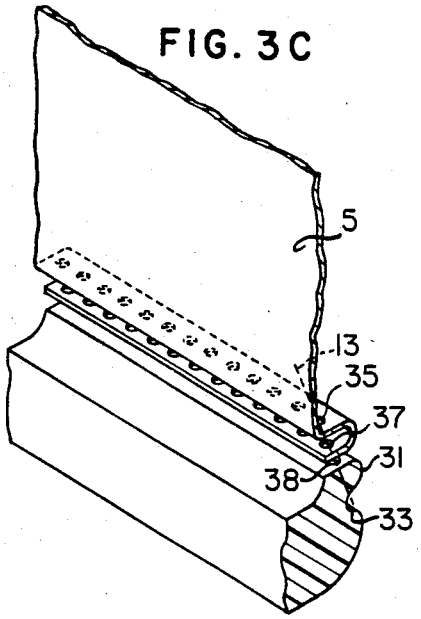
FIG. 3D
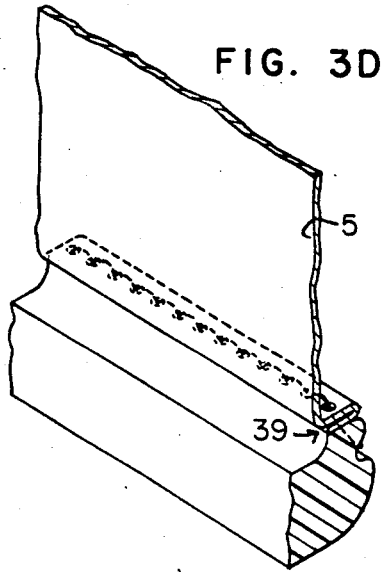
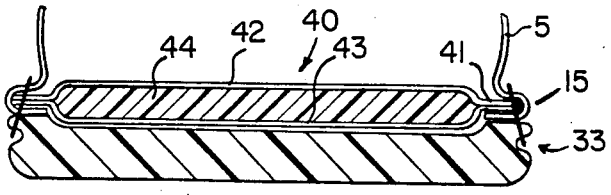
FIG. 4

CALIFORNIA-TYPE SHOE

BACKGROUND OF THE INVENTION

This invention relates to a California-type shoe and a stitched-down shoe.

In a conventional California-type shoe, a cushioned platform provides the wearer with increased comfort. However, a conventional California-type shoe requires an insole which reduces the flexibility of the shoe and adds unnecessary weight to the shoe thereby detracting from the shoe's comfort. The insole also adds material and expense to the manufacture of the shoe.

In a conventional stitched-down shoe, the cut edge of the upper material is flanged outwardly and is usually attached by adhesive and stitching to a layer of rigid material which in turn is attached to the outer sole. In some cases, the outwardly-flanged cut edge is stitched directly to the sole of the shoe. It is customary to prepare the cut edge with a special tool to insure that it is smooth. It is also customary to dye the cut edge since it is usually a different color than either the shoe base or the leather surface of the upper itself. In a conventional stitched-down shoe, a thick leather is necessary for durability, since a thin single layer of leather may tear from the stitching due to the normal forces of wearing the shoe.

SUMMARY OF THE INVENTION

It is an object of the invention to provide a shoe with increased flexibility.

Another object of the invention is to provide a shoe with increased comfort.

Another object of the invention is to provide a shoe having a lighter weight than a conventional California-type shoe.

Another object of the invention is to provide a shoe without an insole.

Another object of the invention is to provide a shoe that does not have an exposed cut edge.

Another object of the invention is to provide a shoe made from thin leather stitched directly to the shoe base and capable of withstanding the forces of normal wear.

Another object of the invention is to provide a California-type shoe that can be hand sewn.

According to the invention, a shoe is provided with an upper having a folded-over edge and a sole having a stitching edge. The folded-over edge is stitched directly to the stitching edge of the sole. The cut edge is turned inwardly and is not exposed. The raw cut edge does not have to be cut with a special tool or dyed as is the case where the raw cut edge is outturned. This eliminates manufacturing steps and results in a shoe that is more attractive than a shoe having an exposed raw cut edge which has been dyed. Also, the double layer of leather in the folded-over edge increases the durability of the attachment of the upper to the sole making it possible to use a thinner leather than is possible in a conventional stitched-down shoe. Finally, the upper may be hand sewn to the sole making it possible to use a stronger thread than is possible when the upper is machine sewn to the sole.

Also, according to the invention, a shoe is provided with an upper having a folded-over edge, a sock-lining and a sole having a stitching edge. The folded-over edge then captures the sock-lining in a three-layer seam. This three-layer seam is then sewn directly to the stitching edge of the sole. Unlike the California-type shoe which requires an insole and a wrapper for lasting to achieve a platform look, the shoe of this invention does not require an insole or a wrapper, making it lighter and more flexible than the California-type shoe. Not only is the material for the insole and wrapper not required, but the manufacturing step for adding the insole and wrapper to the shoe is eliminated. Finally, unlike the California-type shoe, the upper may be hand sewn to the sole.

The sole may be provided with a lateral stitching groove running about its periphery parallel to the stitching edge and with indentations which pass part way from the stitching edge to the stitching groove. The lateral stitching groove protects the stitching from abrasion and, to some extent, from moisture. The indentations facilitate hand-stitching and enhance the water resistant features of the attachment of the upper to the sole.

Also according to the invention, a method for making a shoe from an upper and a sole is provided. An inner row of holes and a parallel outer row of holes are prepunched along the lower margin of the upper. The lower margin of the upper is folded-over so that the parallel rows of holes are aligned. This folded-over edge is then stitched through the aligned holes into the sole.

Also according to the invention, a method for making a shoe from an upper, a sock-lining, and a sole is provided. An inner row of holes and a parallel outer row of holes are prepunched along the lower margin of the upper. The sock-lining is then sewn to the outer row of holes. The lower margin of the upper is then folded-over so that the holes of the parallel rows are aligned. Then the folded-over edge is attached to the sole by stitching through the aligned holes and into the sole.

These and other features are illustrated in the drawings and more particularly described below.

BRIEF DESCRIPTION OF THE DRAWINGSS

FIGS. 3A through 3D are step-wise schematic representations of the method for carrying out the invention shown in FIG. 2;

FIG. 4 is a cross sectional view similar to that of FIG. 2 of the preferred embodiment of the invention;

DETAILED DESCRIPTION OF THE PREFERRED EMBODIMENTS

Figure 1:
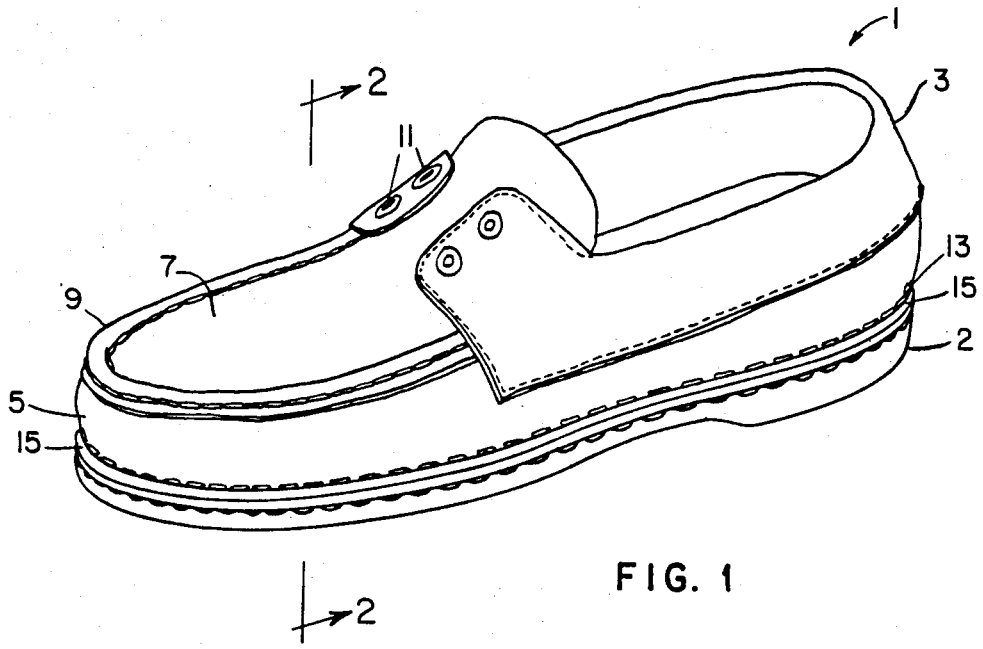
FIG. 1 is a side elevational view of a shoe according to the invention.

FIG. 1 illustrates the shoe according to the invention. Generally, the shoe 1 has a sole 2 and an upper 3. The upper 3 is attached to the sole 2. The upper preferably has a vamp portion 5 and a plug portion 7. The plug portion 7 is sewn, preferably hand-sewn, to the vamp portion 5 along a seam 9. The vamp portion 5 is attached to the sole 2 by hand stitching 13 through a folded-over edge 15 and into the sole 2. The plug portion 7 may be sewn to the vamp portion 5 either before or after the vamp portion 5 is sewn to the sole 2. In the preferred embodiment, the sole 2 is a pre-molded polyurethane unit. The shoe 1 is provided with conventional lace eyelets 16.

Figure 2:
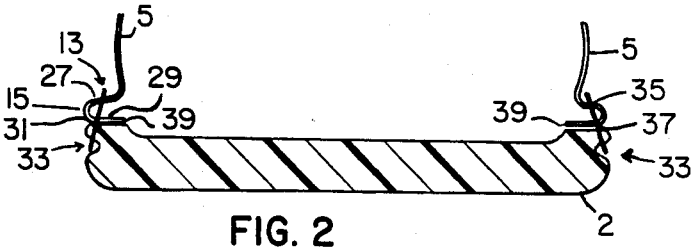
FIG. 2 is a cut away cross sectional view along line 2—2 of FIG. 1.
Figure 2A:
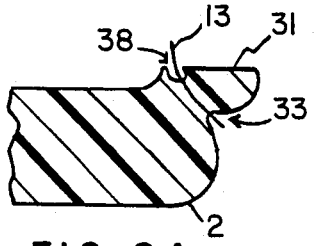
FIG. 2A is an enlarged view of the stitching groove of the preferred embodiment.

FIG. 2 describes with more particularity how the vamp portion 5 is sewn to the sole 2. To attach the vamp portion 5 to the sole 2, hand-stitching 13 passes through the top layer 27 of the folded-over edge 15, through the bottom layer 29 of the folded-over edge 15, into the stitching edge 31 of the sole 2 and to the stitching groove 33 of the sole 2. The folded-over edge 15 may be provided with an inner row of holes 35 and an outer row of holes 37 to facilitate hand stitching. The cut edge 39 is turned-in and not exposed. The angle of the stitching is at or about 45 degrees from the plane of the sole in the preferred embodiment, although other stitching angles, including angles substantially perpendicular to the plane of the sole, are possible (FIG. 2A). The folded-over edge 15 is durable and attractive.

FIGS. 3A through 3D illustrate more particularly the method for attaching the vamp portion to the sole according to the invention. The vamp portion 5 is provided with an inner row of holes 35 and an outer row of holes 37 at its lower margin. The lower margin is then turned outwardly and folded underneath itself to form a double layer folded-over edge having a top layer 27 and a bottom layer 29. The inner row of holes 35 and the outer row of holes 37 are in this manner brought into alignment. Stitching 13 is then passed via the stitching groove 33 into the indentation 38, through the sole 2, out the stitching edge 31, and into and through an aligned pair of holes of the outer and inner row of holes 37, 35. The folded-over edge is stitched down to the sole in this manner. The stitching is preferably a double thread lock stitch.

The folded-over edge provides a shoe with a more attractive appearance than a conventional stitched-down shoe where the outwardly flanged edge is the cut edge. As shown in FIGS. 2 and 3, the cut edge 39 is turned inward according to the invention. The cut edge does not need to be cut with a special tool or dyed. The double layer folded-over edge also adds strength to the attachment of the upper to the sole making it possible to use a thinner leather than is possible with conventional stitched-down shoes. The invention reduces the weight of the shoe, adds to the comfort, and allows for a more elegant appearance.

The lateral stitching groove 33 of the sole 2 makes it possible to recess the stitching 13 from the lateral face of the sole 2. This protects the stitching from abrasion and protects the stitching to a certain extent from moisture. The lateral stitching groove according to the preferred embodiment of the invention is provided with indentations 38 which pass part way from the stitching edge 31 to the stitching groove 33 (FIG. 2A). These indentations correspond to the stitching holes 35, 37 and facilitate hand-stitching by providing markings to indicate where to stitch and by making it easier to puncture the sole with a needle. Indentations are used instead of prepunched holes to enhance the water resistant features of the attachment of the upper to the sole. Unlike a thread passing through a prepunched hole, the sole material compressively engages the thread to form a seal against moisture.

FIG. 4 illustrates another embodiment of the invention, which embodiment is considered an improvement over the California type shoe. The folded-over edge 15 of the vamp 5 captures a sock-lining, generally indicated at 40, at the sock-lining margin 41. This three-layer seam is then stitched directly to the sole. Unlike the California-type shoe, this construction does not require an insole or a wrapper. The sock-lining includes in the preferred embodiment a sock liner 42 and a sock-lining reinforcer 43, which fabrics capture a foam pad 44.

Figure 5A:
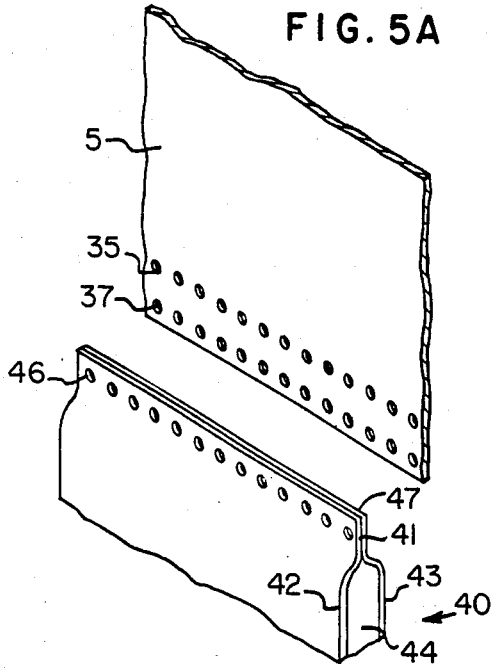
FIGS. 5A through 5D are step-wise schematic representations of one method for carrying out the invention shown in FIG. 4.
Figure 5B:
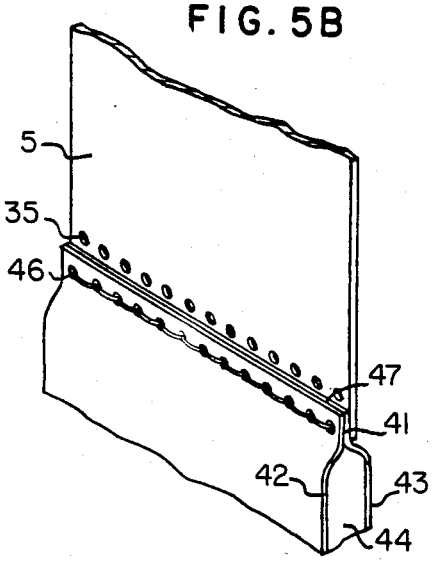
Figure 5C:
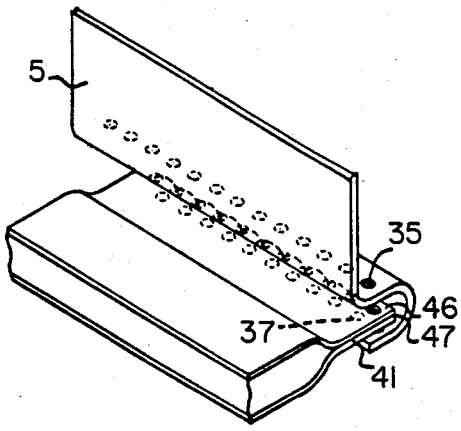
Figure 5D:
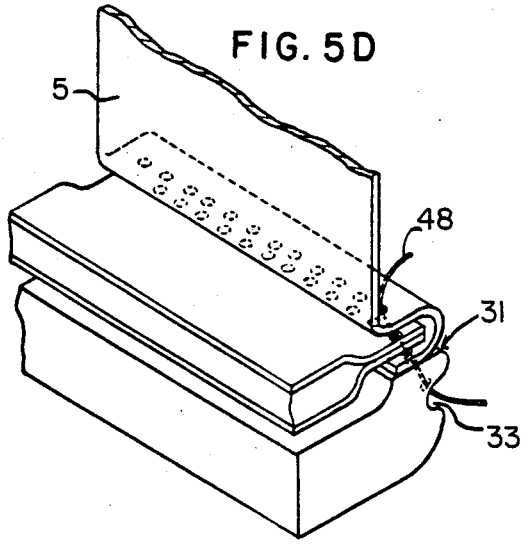

One method for making this embodiment is more particularly shown in FIGS. 5A through 5D. The vamp portion 5 is provided with two rows of holes, an inner row 35 and an outer row 37. The sock-lining 40 is provided at its margin 41 with a third row of sock-lining holes 46 which mate with the two rows of holes 35, 37 of the vamp portion 5. These sock-lining holes 46 are hand sewn to the outer row of holes 37 (FIG. 5B). The vamp portion is then folded around the outer edge 47 of the sock-lining such that the inner row of holes 35 is brought into alignment with the sock-lining holes 46 and the outer row of holes 37. Threads 48 may then be passed through the aligned holes of the three layers into the stitching edge 31 and to the lateral stitching groove 33 of the sole 2.

Figure 6A:
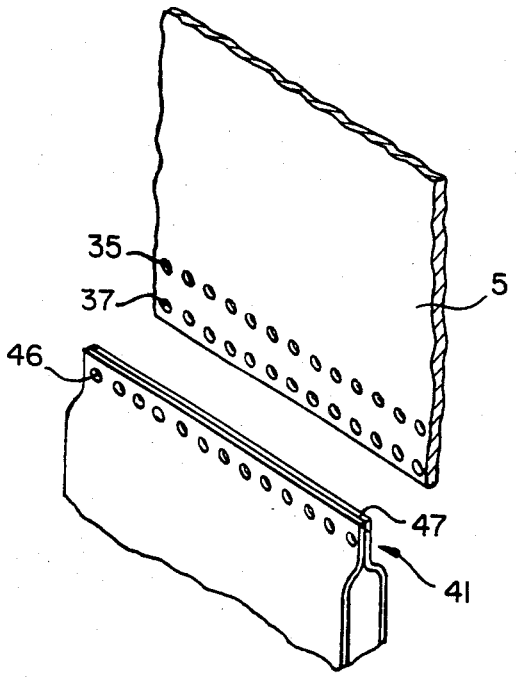
FIGS. 6A through 6C are step-wise schematic representations of a second method for carrying out the invention shown in FIG. 4.
Figure 6B:
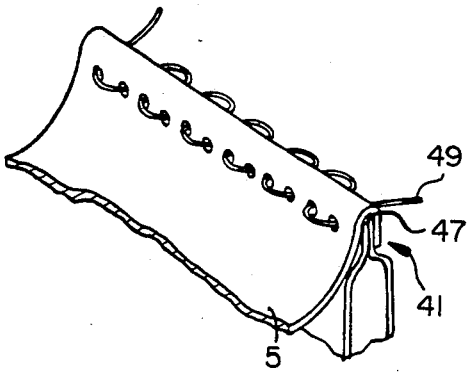
Figure 6C:
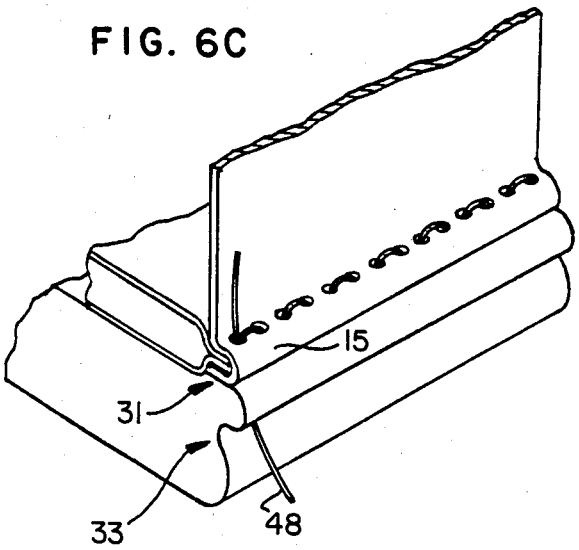

A second method for making the embodiment shown in FIG. 4 is more particularly shown in FIGS. 6A through 6C. As was the case in FIG. 5A, the vamp portion 5 is provided at its lower margin with two rows of holes, an inner row of holes 35 and an outer row of holes 37. The sock-lining is provided at sock lining margin 41 with a third row of sock-lining holes 46 which mate with the two rows of holes 35, 37 in the vamp portion 5. The lower margin of vamp portion 5 is folded around the outer edge 47 of the sock-lining to sandwich the sock-lining margin 41 such that the inner row of holes 35 is brought into alignment with the sock-lining holes 46 and the outer row of holes 37. A base stitch 49 is then passed through the aligned holes of the three layers to capture the sock-lining margin in the folded-over edge. Threads 48 may then be passed through the aligned holes of the three layers into the stitching edge 31 and to the lateral stitching groove 33 of the sole 2 to attach the folded-over edge 15 to the sole 2.

Unlike the California-type shoe in which a padded sock liner is stitched only to the upper, the padded sock liner of this invention is sandwiched firmly in a three-layer seam and stitched to the sole. The resulting shoe provides a stronger attachment for the padded sock-lining. It also provides all the advantages discussed above of a folded-over edge stitched down to the sole. Moreover, the invention eliminates the inner sole to provide a more-flexible and more-comfortable shoe. Additionally, unlike the California-type shoe, the shoe can be hand-sewn.

Figure 7:
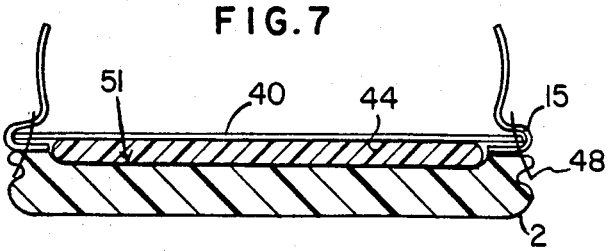
FIG. 7 is a cross-sectional view similar to that of FIG. 2 of another embodiment of the invention.

FIG. 7 illustrates another embodiment of the invention. Here a foam pad 44 is adhesively attached directly to the upper surface 51 of the sole 2 of the shoe. The margin of the sock liner 40 is captured in a folded-over edge 15 to form a three layer seam which is sewn by stitching 48 directly to the sole 2 of the shoe. The sock-liner 40 covers the foam pad 44 instead of capturing it as in the embodiment described in FIGS. 4 and 5.

Figure 8:
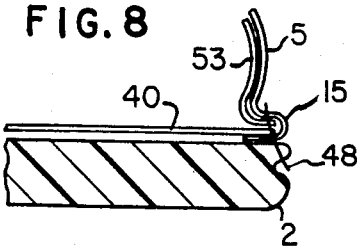
FIG. 8 is a cross-sectional view similar to that of FIG. 2 of another embodiment of the invention.

FIG. 8 describes still another embodiment of the invention. Here, the vamp portion 5 is lined with a vamp liner 53. The folded-over edge 15 captures both the vamp liner 53 and the sock liner 40 to form a four layer seam. The four layer seam is then attached directly to the sole 2 by stitching 48.

It should be understood that various changes and modifications of the embodiments shown in the drawings may be made within the scope of this invention. Thus, it is intended that all matter contained in the above description or shown in the accompanying drawings shall be interpreted in an illustrative and not limiting sense.

What I claim is:

1. A hand sewn shoe comprising, an upper having a folded over edge, a sole having a stitching edge and a lateral stitching groove running parallel to the stitching edge, and indentations which pass part way between the stitching edge and the stitching groove, wherein the folded-over edge is stitched directly to the stitching edge and the stitching passes through the indentations.

2. A method for making a hand sewn shoe from an upper having a vamp portion with a lower margin and a plug portion, and a sole having indentations to facilitate hand stitching comprising, forming a folded-over edge along the lower margin of the vamp portion, hand stitching the folded-over edge to the sole such that the stitching passes through the indentations and, hand stitching the plug portion to the vamp portion.

3. A method for making a hand sewn shoe from an upper having a vamp portion with a lower margin and a plug portion, and a sole having indentations to facilitate hand stitching comprising, prepunching two parallel rows of holes along the lower margin of the vamp portion, forming a folded-over edge along the lower margin of the vamp portion such that the holes of the parallel rows are aligned, attaching the folded-over edge to the sole by hand stitching through the aligned prepunched holes and into the sole such that the stitching passes through the indentations, and hand stitching the plug portion to the vamp portion.

4. A method for making a hand sewn shoe from an upper having a vamp portion with a lower margin and plug portion, and a sole having indentations to facilitate hand stitching comprising, hand stitching the plug portion to the vamp portion, forming a folded-over edge along the lower margin of the vamp portion, and hand stitching the folded-over edge to the sole such that the stitching passes through the indentations.

5. A method for making a hand sewn shoe from an upper having a vamp portion with a lower margin and a plug portion, and a sole having indentations to facilitate hand stitching as claimed in claim 4 further comprising, prepunching an inner and an outdr parallel row of holes along the lower margin of the vamp portion, before forming the folded-over edge, forming the folded-over edge along the lower margin of the vamp portion such that the holes of the parallel rows are aligned, and attaching the folded-over edge to the sole by hand stittching through the aligned prepunched holes and into the sole.

6. A method for making a shoe from an upper having a vamp portion with a lower margin and a plug portion, and a sole as claimed in claim 5, further comprising, providing a sock-lining having a sock-lining margin, sewing the sock-lining margin to the outer row of holes and, forming a folded-over edge such that the folded-over edge sandwiches the sock-lining margin.

7. A method for making a shoe from an upper having a vamp portion with a lower margin and a plug portion as claimed in claim 5 further comprising, providing a sock-lining with a sock-lining margin, forming the folded-over edge along the lower margin of the vamp portion such that it sandwiches the sock-lining margin, base stitching the folded-over edge through the aligned rows of holes to capture the sock-lining margin in the folded-over edge, and attaching the base-stitched folded-over edge to the sole by stitching through the folded-over edge and into the sole.

8. A method for making a shoe from an upper having a vamp portion with a lower margin and a plug portion as claimed is claim 7 further comprising, prepunching a row of sock-lining holes along the sock-lining margin which sock-lining holes mate with the outer and inner rows of holes along the lower margin of the vamp portion, forming a folded-over edge along the lower margin of the vamp portion and sandwiching the sock-lining margin in the folded-over edge such that the inner and outer parallel rows of holes and the sock-lining holes are aligned.

9. A method for making a hand sewn shoe from an upper having a lower margin and a sole having indentations to facilitate hand stitching comprising, forming a folded-over edge along the lower margin of the upper, and hand stitching the folded-over edge to the sole such that the stitching passes through the indentations.

10. A method for making a hand sewn shoe from an upper having a lower margin and a sole having indentations to facilitate hand stitching as claimed in claim 9 further comprising, first prepunching an inner and outer parallel row of holes along the lower margin of the upper, forming the folded-over edge along the lower margin of the upper such that the holes of the parallel rows are aligned, and stitching the folded-over edge to the sole by hand stitching through the aligned prepunched holes and into the sole.

11. A method for making a shoe from an upper having a lower margin and a sole as claimed in claim 9 comprising, providing a sock-lining having a sock-lining margin, and forming the folded-over edge such that it sandwiches the sock-lining margin.

12. A method for making a shoe from an upper having a lower margin and a sole as claimed in claim 11 further comprising, sewing the sock-lining margin to the lower margin of the upper before forming the folded-over edge.

13. A method for making a shoe from an upper having a lower margin and a sole as claimed in claim 12 further comprising, first prepunching an inner and an outer parallel row of holes along the lower margin of the upper, sewing the sock-lining margin to the lower margin of the upper by sewing the sock-lining margin to the outer row of holes, and forming the folded-over edge such that the holes of the parallel rows are aligned.

14. A method for making a shoe from an upper having a lower margin and a sole as claimed in claim 13 further comprising, prepunching a row of sock-lining holes along the sock-lining margin which sock-lining holes mate with the inner and outer row of holes along the lower margin of the upper, and sewing the sock-lining margin to the outer row of holes by sewing the sock-lining holes to the mating outer row of holes.

15. A method for making a shoe from an upper having a lower margin and a sole as claimed in claim 11 further comprising, capturing the sock-lining margin in the folded-over edge by base-stitching before stitching the folded-over edge to the base.

16. A method for making a shoe from an upper witn a lower margin and a sole as claimed in claim 15 further comprising, prepunching an inner and outer parallel row of holes along the lower margin of the upper, prepunching sock-lining holes along the sock-lining margin which sock-lining holes mate with the inner and outer row of holes along the lower margin of the upper, forming the folded-over edge along the lower margin of the upper and sandwiching the sock-lining margin in this folded-over edge such that the inner and outer parallel rows of holes and the sock-lining holes are aligned, capturing the sock-lining in the folded-over edge by base stitching through the aligned rows of holes, and attaching the folded-over edge to the sole by stitching through the aligned holes and into the sole.

* * * * *